US011111774B2

(12) United States Patent
McCormick

(10) Patent No.: US 11,111,774 B2
(45) Date of Patent: Sep. 7, 2021

(54) SENSOR TRANSPORTATION APPARATUS

(71) Applicant: PETROMAC IP LIMITED, Hamilton (NZ)

(72) Inventor: Stephen Peter McCormick, Hamilton (NZ)

(73) Assignee: PETROMAC IP LIMITED, Hamilton (NZ)

( * ) Notice: Subject to any disclaimer, the term of this patent is extended or adjusted under 35 U.S.C. 154(b) by 0 days.

(21) Appl. No.: 16/759,847

(22) PCT Filed: Oct. 29, 2018

(86) PCT No.: PCT/NZ2018/050151

§ 371 (c)(1),
(2) Date: Apr. 28, 2020

(87) PCT Pub. No.: WO2019/088850

PCT Pub. Date: May 9, 2019

(65) Prior Publication Data

US 2020/0308953 A1 Oct. 1, 2020

(30) Foreign Application Priority Data

Nov. 1, 2017 (NZ) ..... 736902

(51) Int. Cl.
*E21B 47/013* (2012.01)
*E21B 47/017* (2012.01)
*E21B 23/14* (2006.01)

(52) U.S. Cl.
CPC ..... *E21B 47/013* (2020.05); *E21B 23/14* (2013.01); *E21B 47/017* (2020.05)

(58) Field of Classification Search
CPC ..... E21B 47/013; E21B 47/017; E21B 23/14
See application file for complete search history.

(56) References Cited

U.S. PATENT DOCUMENTS 4,577,705 A * 3/1986 Cross ..... E21B 10/24 175/228
8,011,429 B2 9/2011 McNay
(Continued)

FOREIGN PATENT DOCUMENTS

WO 2014077707 A1 5/2014

OTHER PUBLICATIONS

Australian Patent Office, International Search Report, PCT/NZ2018/050151, dated Feb. 21, 2019, 6 pages.
(Continued)

*Primary Examiner* — D. Andrews
(74) *Attorney, Agent, or Firm* — Dann, Dorfman, Herrell and Skillman, P.C.

(57) ABSTRACT

A sensor transportation apparatus for conveying a sensor assembly through a wellbore comprises at least one engagement structure to connect the sensor transportation apparatus to the sensor assembly, at least one axle, a bearing connected to the axle, and a wheel connected to the bearing and provided with a shaft seal to prevent or reduce debris from the wellbore entering the bearing, and a lubrication delivery system to provide a lubricant to the bearing at a pressure which is greater than ambient wellbore pressure. The lubrication system comprises a bellows formation, and the apparatus comprises a housing to contain the lubricant, the housing in fluid communication with the bearing, the bellows formation sealingly mounted to the housing with at least a portion of the bellows received within the housing.

12 Claims, 6 Drawing Sheets

(56) References Cited

U.S. PATENT DOCUMENTS

| | | | | |
|---|---|---|---|---|
| 8,215,844 | B1 | 7/2012 | Hoyt | |
| 2013/0248208 | A1 | 9/2013 | Copold et al. | |
| 2014/0238659 | A1 | 8/2014 | Wheater et al. | |
| 2015/0308207 | A1* | 10/2015 | McCormick ..... | E21B 17/10<br>104/138.2 |

OTHER PUBLICATIONS

Australian Patent Office, Written Opinion of the ISA, PCT/NZ2018/050151, dated Feb. 21, 2019, 7 pages.

* cited by examiner

SENSOR TRANSPORTATION APPARATUS

STATEMENT OF CORRESPONDING APPLICATIONS

This application is based on the Provisional specification filed in relation to New Zealand Patent Application Number 736902, the entire contents of which are incorporated herein by reference.

TECHNICAL FIELD

This invention relates to apparatus for use in transporting sensor equipment, and in particular to apparatus for use in wireline logging applications.

BACKGROUND ART

Hydrocarbon exploration and development activities rely on information derived from sensors which capture data relating to the geological properties of an area under exploration. One approach used to acquire this data is through wireline logging. Wireline logging is typically performed in a wellbore immediately after a new section of hole has been drilled. These wellbores are drilled to a target depth covering a zone of interest, typically between 1000-5000 meters deep. A sensor package, also known as a "logging tool" or "tool-string" is then lowered into the wellbore and descends under gravity to the target depth of the wellbore well. The logging tool is lowered on a wireline—being a collection of electrical communication wires which are sheathed in a steel armour cable connected to the logging tool. Once the logging tool reaches the target depth it is then drawn back up through the wellbore at a controlled rate of ascent, with the sensors in the logging tool operating to measure and record geological data.

The drilling of wells and the wireline logging operation is an expensive undertaking. This is primarily due to the capital costs of the drilling equipment and the specialised nature of the wireline logging systems. It is important for these activities to be undertaken and completed as promptly as possible to minimise these costs. Delays in deploying a wireline logging tool are to be avoided wherever possible.

One cause of such delays is the difficulties in lowering wireline logging tools down to the target depth of the wellbore. These wellbores are often rugose with washed out over-gauge sections and residual cuttings that have been left behind by the drilling process. Further, the wellbore is filled with drilling mud which contains fine rock cuttings in suspension. Most wells are deviated. Deviated wells are drilled at an angle from the vertical.

As the logging tool is lowered by cable down the wellbore by gravity alone, the winch operator at the top of the well has very little control of the descent of the logging tool. Logging tools can become held up on rock ledges—which are often found at the boundaries of rock formations where the overlaying rock layer is washed out and overgauge. An operator may spend a significant amount of time reeling the cable and tool-string back in and attempting to move it past the obstruction formed by a ledge.

The chances of a wireline logging tool getting held-up or impeded are significantly increased with deviated wells. As hole deviation increases, the sliding friction can prevent the logging tool descending. The practical hole deviation limit for a standard logging tool is around 50-60° from the vertical.

Attempts have been made to address the issues involved in the deployment of wireline logging tools. McNay patent U.S. Pat. No. 8,011,429 and Schumberger patent application US2013/248208 describe roller assemblies which slip over the logging tool, and are mounted such that they are free to rotate about the longitudinal axis of the tool. These devices have relatively small wheels which do not rotate easily over rough surfaces. In addition, it is often the central or side part of the wheel which is in contact with the wellbore wall, rather than the circumferential or radially extreme edge. This means that the wheels are often skidding rather than rotating. Neither of these devices has an active lubrication system to prevent contaminants from entering and jamming the bearings.

International publication WO2014/077707 describes another roller assembly device with relatively large wheels and a pressure compensated lubrication system which works well to carry logging tools down deviated wells at angles much greater than can be achieved without the device. The lubrication system includes a stretched elastic diaphragm containing the lubricant so that the pressure in the lubricant is higher than the well bore ambient pressure. Other lubrication systems utilise spring energised pistons which are prone to sticking and hence unable to reliably provide a small and responsive pressure difference.

One issue with the roller assembly type devices of the prior art is high friction in the wheel bearing assemblies. While the bearings may have acceptable low resistance to turning once they are moving (i.e. low dynamic friction), the torque required to start the wheel turning may be greater than ideal (that is, there may be relatively high static friction in the bearing assembly). This characteristic can lead to the tool moving in a series of starts and stops, rather than moving at a constant speed, particularly when the tool is used at greater depths requiring a particularly long wireline cable. Long wireline cables behave elastically, much like a spring. During logging the cable is wound at a constant speed on to a drum at surface. If the tool is stationary, the cable will stretch as it is wound onto the drum. Tension in the cable will continuously increase until the static friction of the downhole logging tool is overcome.

At this point the accumulated cable tension causes the tool to accelerate up the wellbore and "overshoot". Cable tension with the "overshot tool" is released such that there is not enough to maintain the tool movement and the cycle starts again. This type of stop/start movement can result in 'overshoots' which can often exceed 10 metres, even though the cable at the surface is winding onto a drum at a constant speed. Subsurface data is measured at a constant rate based on the surface cable speed, and consequently the stop/start movement of the tool can severely compromises the accuracy of the measurement and create depth uncertainty, in many cases rendering the measurement invalid, and may make some types of measurement difficult or impossible to perform.

Any reduction in dynamic and static friction from such roller devices is very advantageous. The reduced friction enables wireline logging by gravity descent in highly deviated wellbores. Descending by gravity alone (e.g. conventional wireline logging) is more efficient than other forms of wireline logging (e.g. a powered transportation apparatus) in terms of cost and time. In addition, the logging operation is safer because higher cable tensions are maintained at the toolstring connection which reduces the risk of "bird-caging". Bird-caging is where the armour strands of the logging cable separate and deform when it is put in compression or reduced tension. A birdcaged cable can result in armour de-stranding, sticking or even breakage—all of which are very costly.

Further, cable tensions are reduced while logging out of hole, minimising risk of gear failure and cable key-seat sticking. Key-seat sticking occurs when the cable wears a groove into the rock which jams the larger diameter tool body.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

It is an object of the present invention to address one or more of the foregoing problems or at least to provide the public with a useful choice.

Further aspects and advantages of the present invention will become apparent from the ensuing description which is given by way of example only.

DISCLOSURE OF THE INVENTION

According to one aspect, the present invention broadly consists in a sensor transportation apparatus for conveying a sensor assembly through a wellbore, the sensor transportation apparatus comprising:

at least one engagement structure to connect the sensor transportation apparatus to the sensor assembly, at least one axle, a bearing connected to the axle, and a wheel connected to the bearing and provided with a shaft seal to prevent or reduce debris from the wellbore entering the bearing, wherein a sealing lip of the shaft seal is sealingly engaged with a wear surface, wherein the wear surface is a tungsten carbide wear surface or has a Vickers Hardness number of at least 1100.

In some embodiments, the wear surface is a tungsten carbide wear surface or has a Vickers Hardness number of at least 1300.

In some embodiments, the shaft seal is a radial shaft seal.

In some embodiments, the apparatus comprises a sleeve which is mounted to the axle, wherein a radially outer surface of the sleeve comprises the wear surface.

In some embodiments, a radially outer surface of the axle comprises the wear surface.

In some embodiments, the shaft seal is an axial shaft seal.

In some embodiments, the bearing comprises a ball bearing.

In some embodiments, the bearing comprises a double row ball bearing and more preferably the bearing comprises a double row angular contact ball bearing.

In some embodiments, the bearing comprises a 4 point contact ball bearing.

In some embodiments, the bearing comprises a taper roller bearing, and preferably the bearing comprises 2 taper roller bearing mounted to take axial loads in both directions.

In some embodiments, the apparatus comprises a lubrication delivery system to provide a lubricant to the bearing at a pressure which is greater than ambient wellbore pressure.

In some embodiments, the lubrication delivery system comprises:

a bellows formation, and the apparatus comprising a housing to contain the lubricant, the housing in fluid communication with the bearing, the bellows formation sealingly mounted to the housing with at least a portion of the bellows received within the housing.

In some embodiments, an exterior of the bellows is exposed to or facing the lubricant in use.

In some embodiments, the lubrication delivery means comprises a flexible member, an outer surface of the flexible member in communication with wellbore fluids (typically drilling mud or completion brine) surrounding the apparatus in use, a liquid contained in a sealed chamber defined, at least in part, by the interior of the bellows formation and an inner surface of the flexible member.

In some embodiments, the flexible member is a resilient diaphragm, for example an elastomeric diaphragm.

In some embodiments, the chamber has an invariable volume, such that deflection of the bellows formation causes deflection of the flexible member and vice-versa.

In some embodiments, the liquid comprises silicone oil.

In some embodiments, the lubricant is provided in a volume defined in part by the housing and the exterior of the bellows formation and the shaft seal.

In some embodiments, the wheel bearings are contained in said volume, immersed in the lubricant.

In some embodiments, prior to use, the lubricant is forced into the volume, compressing the bellows formation.

In some embodiments, the bellows formation maintains a higher pressure in the lubricant than the liquid filling the interior of the bellows assembly and hence the wellbore fluid.

In some embodiments, the bellows formation comprises a plurality of metal rings, for example Stainless Steel or Inconel rings.

In some embodiments, the bellows formation is a spring bellows formation to provide a bias force so that the pressure in the lubricant is higher than the pressure of the wellbore fluid surrounding the device.

According to another aspect, the present invention broadly consists in a sensor transportation apparatus for conveying a sensor assembly through a wellbore, the sensor transportation apparatus comprising:

at least one engagement structure to connect the sensor transportation apparatus to the sensor assembly, at least one axle, a bearing connected to the axle, and a wheel connected to the bearing and provided with a shaft seal to prevent or reduce debris from the wellbore entering the bearing, and a lubrication delivery system to provide a lubricant to the bearing at a pressure which is greater than ambient wellbore pressure, wherein the lubrication system comprises:

a bellows formation, and the apparatus comprising a housing to contain the lubricant, the housing in fluid communication with the bearing, the bellows formation sealingly mounted to the housing with at least a portion of the bellows received within the housing.

In some embodiments, an exterior of the bellows formation exposed to or facing the lubricant in use.

In some embodiments, the lubrication delivery means comprises a flexible member, an outer surface of the flexible member in communication with wellbore fluids (typically drilling mud or completion brine) surrounding the apparatus in use, a liquid contained in a sealed chamber defined, at least in part, by the interior of the bellows formation and an inner surface of the flexible member.

In some embodiments, the flexible member is a resilient diaphragm for example an elastomeric diaphragm.

In some embodiments, the chamber has an invariable volume, such that deflection of the bellows formation causes deflection of the flexible member and vice-versa.

In some embodiments, the liquid comprises silicone oil.

In some embodiments, the lubricant is provided in a volume defined in part by the housing and the exterior of the bellows formation and the shaft seal.

In some embodiments, the wheel bearings are contained in said volume, immersed in the lubricant.

In some embodiments, prior to use, the lubricant is forced into the volume, compressing the bellows formation.

In some embodiments, the bellows formation maintains a higher pressure in the lubricant than the liquid filling the interior of the bellows assembly and hence the wellbore fluid.

In some embodiments, the bellows formation comprises a plurality of metal rings, for example Stainless Steel or Inconel rings.

In some embodiments, the bellows formation is a spring bellows formation to provide a bias force so that the pressure in the lubricant is higher than the pressure of the wellbore fluid surrounding the device.

According to another aspect, the present invention broadly consists in a sensor transportation apparatus for conveying a sensor assembly through a wellbore, the sensor transportation apparatus comprising:

at least one engagement structure to connect the sensor transportation apparatus to the sensor assembly, at least one axle, a bearing connected to the axle, and a wheel connected to the bearing and provided with an axial shaft seal to prevent or reduce debris from the wellbore entering the bearing, wherein a sealing lip of the shaft seal is sealing engaged with a wear surface, wherein the wear surface is a tungsten carbide wear surface or has a Vickers hardness of at least 1100. The apparatus may include one or more of the features descried above in relation to other aspects of the present invention.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
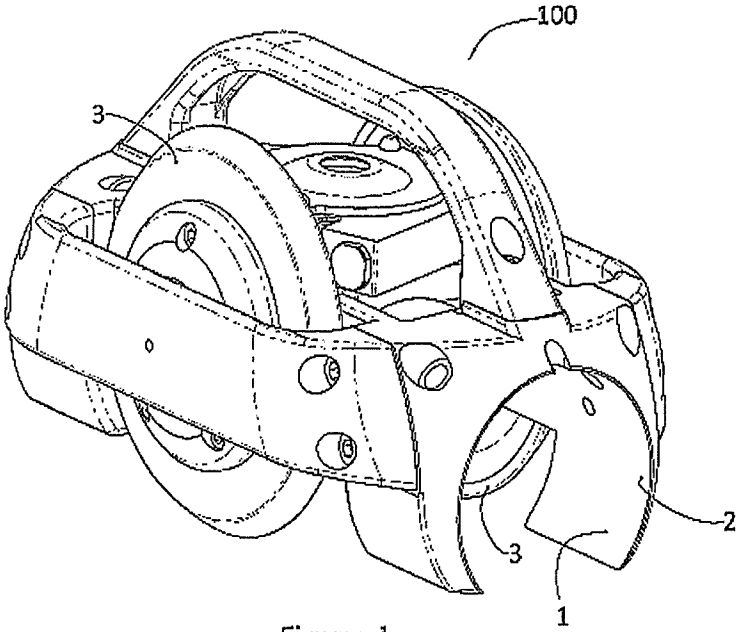
FIG. 1 Is a perspective view of a sensor transportation apparatus according to one embodiment of the present invention.
Figure 2:
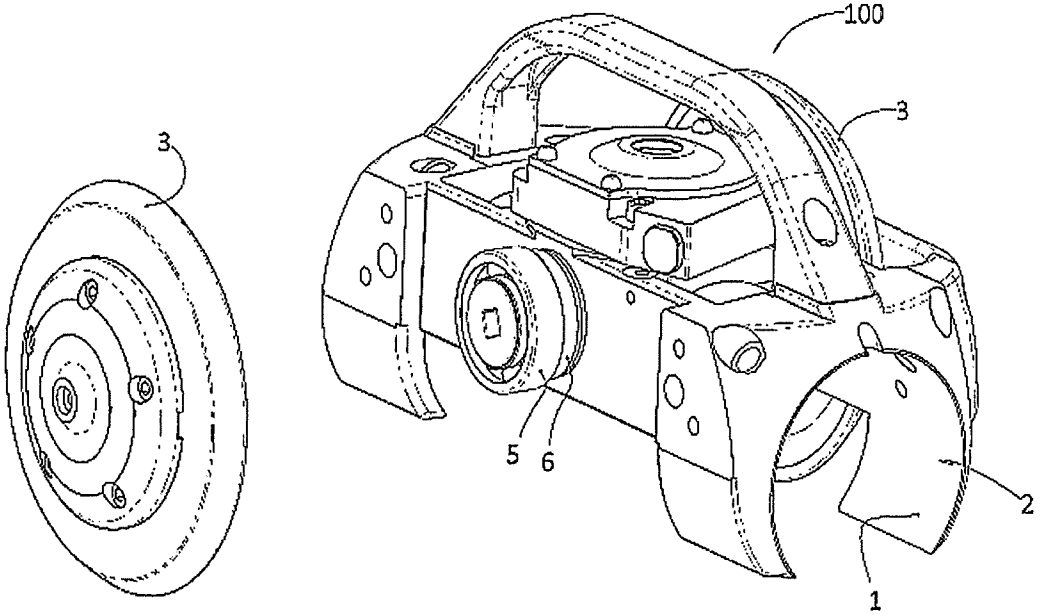
FIG. 2 Is a partially exploded perspective view of the sensor transportation apparatus of FIG. 1, with a protection structure removed for clarity.
Figure 3:
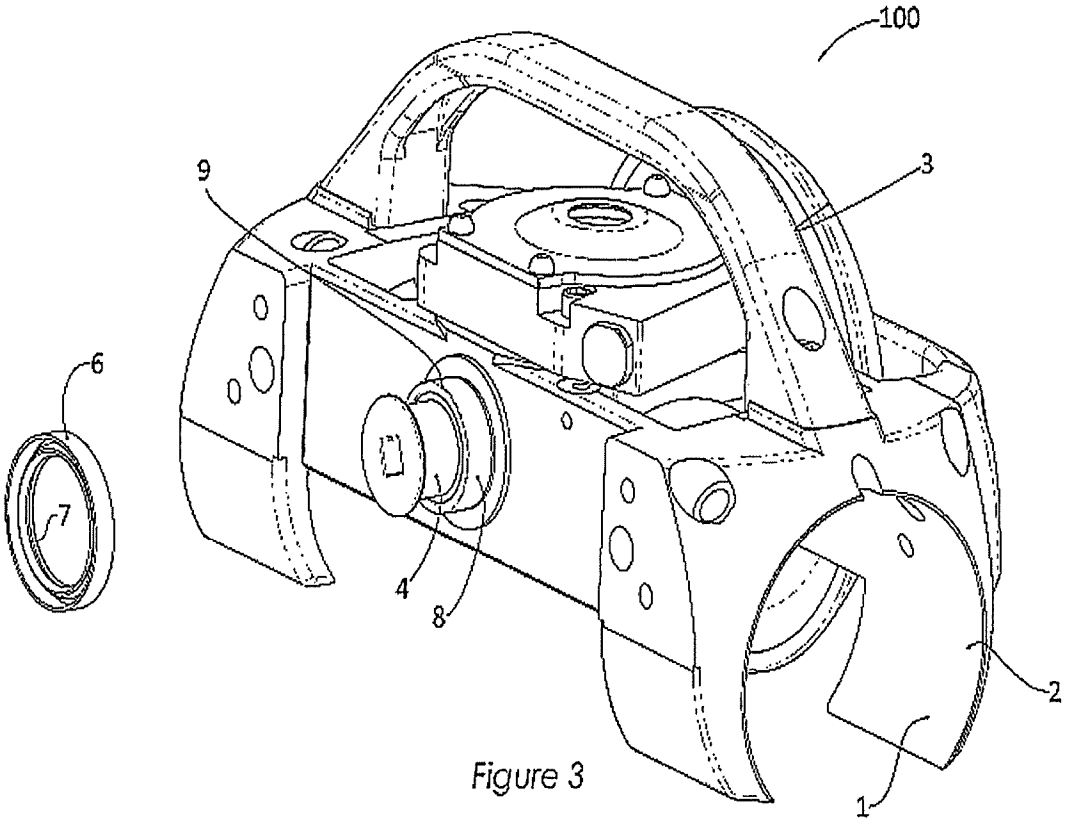
FIG. 3 Is a partially exploded perspective view of the sensor transportation apparatus of FIG. 1 with the protection structure and one wheel and a corresponding bearing removed for clarity.

Referring first to FIGS. 1-3, a sensor transportation apparatus according to one embodiment of the invention is generally referenced by arrow 100. In the embodiment shown the apparatus 100 has a similar external form to that shown in FIGS. 40 and 41 of WO2014/077707, the contents of which are included herein by reference.

The apparatus comprises an engagement structure 1 for connection to a sensor assembly (not shown). In the embodiment shown the engagement structure 1 comprises a locking collar 2 which is arranged to at least partially enclose the exterior side wall surface of the tool-string, allowing the transportation apparatus 100 to be slid on and over the tool-string at any desired position along the length of the tool-string. In other embodiments of the invention the engagement structure 1 may be adapted for in-line connection to the tool-string by means familiar to those skilled in the art.

The apparatus 100 further comprises at least one wheel 3 which is connected to the engagement structure. In the embodiment shown the apparatus comprises two wheels 3, but any number of wheels may be provided, including one wheel or three wheels. In some embodiments the rotational axes of the wheels are substantially parallel and coplanar as shown in the figures. The rotational axes of the wheels are substantially perpendicular to the longitudinal axis of the sensor assembly.

Each wheel 3 is connected to an axle 4 by a bearing 5. In the embodiment shown the bearing 5 is a single row ball bearing, but in some embodiments a double row ball bearing may be used, or even a plain or bush bearing. However, a bearing with rolling elements, e.g. a ball or roller bearing, is preferred as being a more efficient form of bearing than a plain or bush bearing. Rolling element bearings are not only low friction but have little difference between static and dynamic friction. Having minimal difference between static and dynamic drag is an important consideration in the design of the optimal wheel bearing system, to help maintain a more constant tension on the logging tool to prevent or reduce "overshoots" during data recording when winching out of hole.

Figure 8:
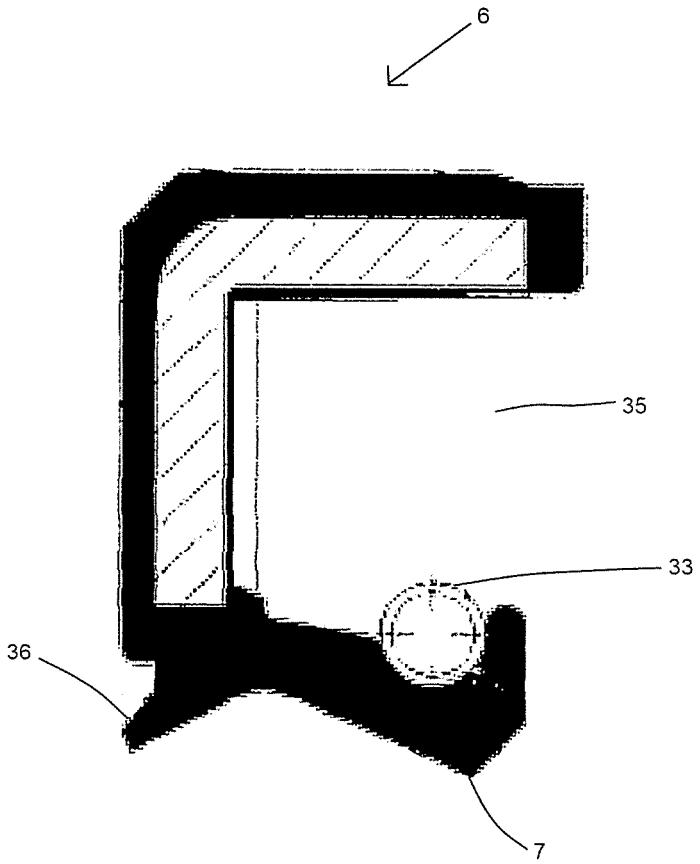
FIG. 8 Is a cross-section view of a radial shaft seal.

In some embodiments double row ball bearings may be preferred due to their ability to roll freely when the load on the bearing includes an axial component, in particular an unbalanced axial component or torque such as that created when the wheels of the apparatus are in contact with the curved surface of the wellbore. Each wheel 3 is provided with a radial shaft seal 6. Preferably the shaft seal is a rotary lip seal 6, as shown in FIG. 8. Rotary lip seals make a thin edge contact with a rotating shaft and consequently have a low static and dynamic friction. An inner sealing lip 7 of the shaft seal 6 bears against the shaft or a wear surface.

The seal 6 may be energized by a garter spring 33, to energise the sealing lip 7 against the shaft or wear surface. The garter spring is received in a spring groove. In use the "spring side" 35 of the rotary seal 6 is oriented toward the lubricant, high pressure side. In the arrangement illustrated in FIGS. 4 and 5, the lubricant pressure energizes the rotary seal to make a tighter grip (seal) between the lip 7 and the rotating shaft or wear surface to prevent leakage of lubricant from the bearing system. The grip of the lip seal increases with pressure hence it is optimal to operate these seals at low pressure differential between the lubricant and the ambient wellbore fluid. The illustrated seal also includes a dust lip seal 36.

In the preferred embodiment the seal bears against a wear surface 8 having a Vickers Hardness number of at least 1100, or at least 1300. Preferably the wear surface is a polished wear surface. Rock cuttings are predominantly quartz. Quartz is a very hard and abrasive material. Quartz is harder than all steel alloys and will cause wear in most bearing systems, increasing friction. Providing a seal against a hard, wear resistant surface reduces seal wear and prevents cuttings entering the bearings.

In a preferred embodiment the wear surface 8 is tungsten carbide. In the embodiment shown in FIGS. 1-6 the wear surface 8 is an outer surface of a tungsten carbide sleeve 9 which is mounted over the axle 4. However, in alternative embodiments the axle 4 itself may be partially or completely formed from tungsten carbide.

The radial shaft seal 6 is preferably Viton™, although other elastomers such as nitrile, hydrogenised nitrile, or Kalrez™ may be also used. In yet another alternative embodiment the axle may have a Tungsten Carbide or Diamond-like Carbon Coating to provide wear resistance.

To reduce friction and prevent or limit wellbore cuttings from entering the bearings, optimally the bearings should be run in a bath of lubricant. Ideally the lubricant bath should be maintained at a pressure that is greater than the wellbore pressure to prevent ingress of wellbore contaminants.

Figure 4A:
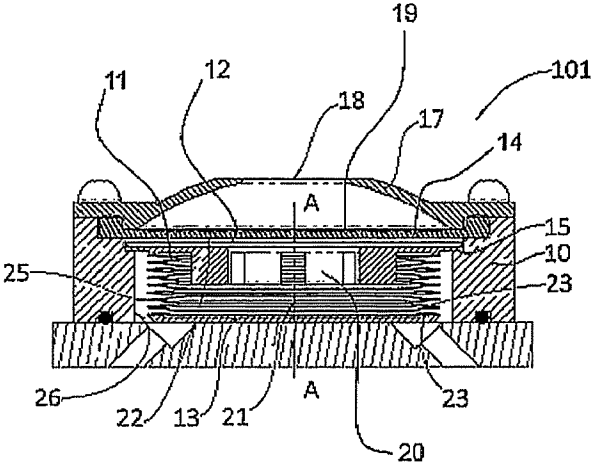
FIG. 4A Is an enlarged transverse cross-section view of the lubrication delivery means of the sensor transportation apparatus of FIG. 1, with the bellows formation in an uncharged state.
Figure 4:
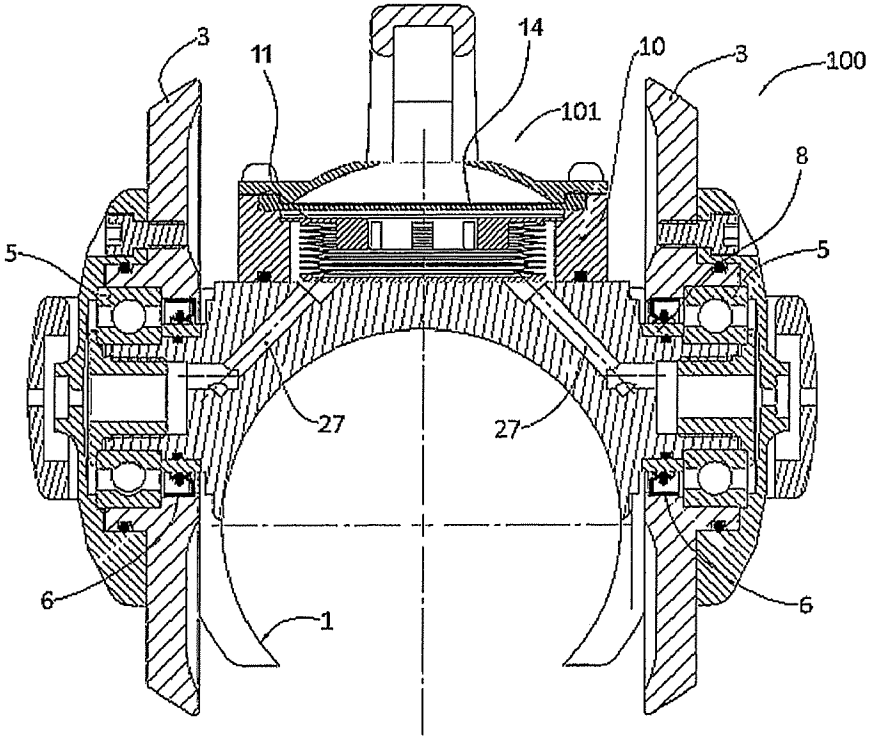
FIG. 4 Is a transverse cross-section view of the sensor transportation apparatus of FIG. 1, with the bellows formation in an uncharged state.
Figure 6:
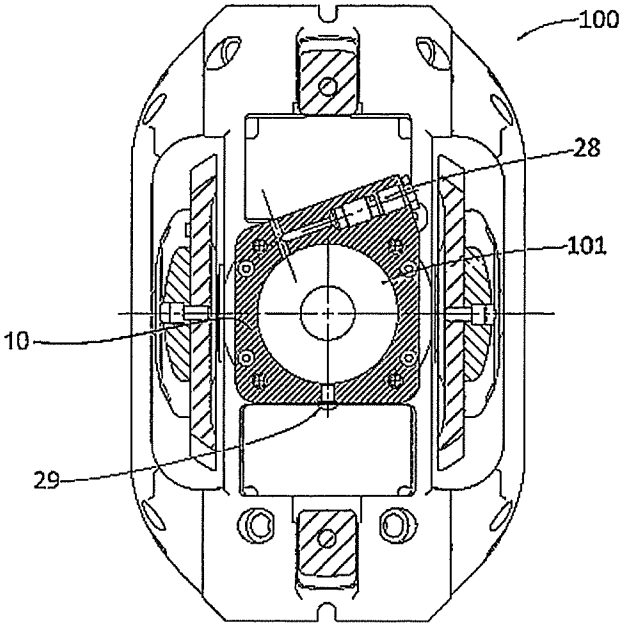
FIG. 6 Is a horizontal cross-section view of the lubrication delivery means showing the filling and bleed port of FIG. 1.
Figure 5:
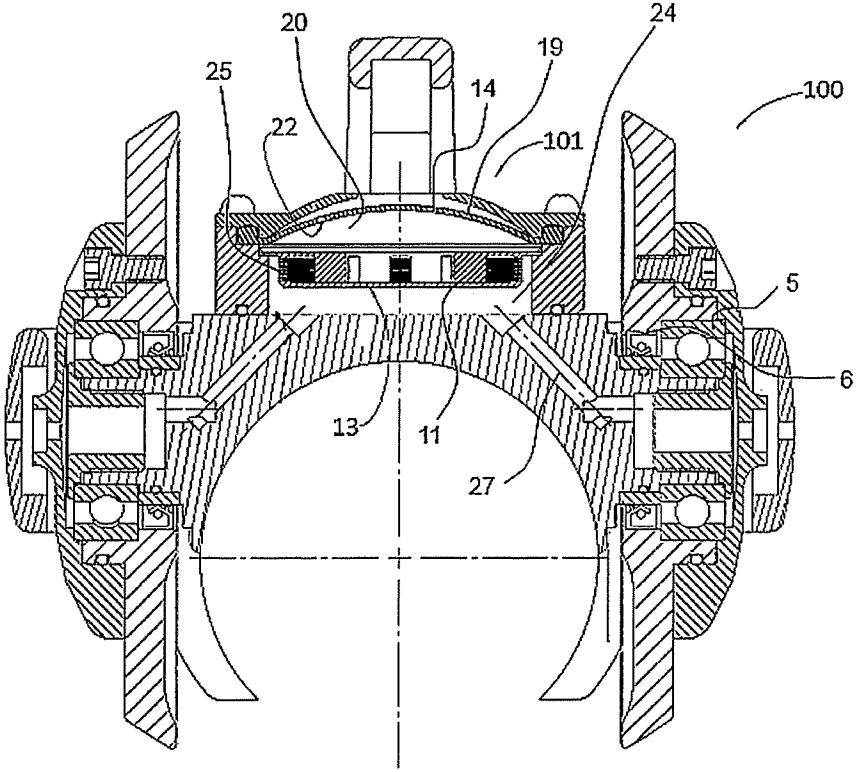
FIG. 5 Is a transverse cross-section view of the sensor transportation apparatus of FIG. 1, with the bellows formation in a charged state.

Referring next to FIGS. 4-6, and in particular FIG. 4A, the apparatus 100 further comprises a lubrication delivery system 101. The lubrication delivery system provides lubricant to the bearing at a pressure which is greater than an ambient pressure in the wellbore (the wellbore pressure or ambient wellbore pressure). The lubricant delivery system comprises a housing 10 within which is provided a bellows formation 11. The bellows formation 11 is sealingly attached to the housing 10 at mounting flange 15. The bellows has a mounting flange 15 to mount the bellows to the housing. The flange may provide a seal with the housing, or a seal may be provided between the flange and housing. With the bellows mounted to the housing, the bellows seals or closes the housing to provide a sealed volume defined by the exterior 25 of the bellows formation 11, an inner surface of the housing 10, and one or more lubricant conduits 27 which extend from the housing to the bearings 5, and the seal 6. The bellows formation 11 has an open end 12 and a closed end 13. A flexible member 14, for example a sheet of rubber or resilient diaphragm such as an elastomeric diaphragm, is sealingly connected to the open end 12 of the bellows formation. The flexible member may be mounted or connected to the housing, as shown in FIG. 4A, to provide a second volume or a chamber 21 defined by an interior of the bellows 11, and an inner surface of the flexible member. A cover 17 is preferably provided over the flexible member 14 and clamps the flexible member 14 to the housing 10. The cover 17 is provided with at least one opening 18 such that the external surface 19 of the flexible member 14 is in communication with the wellbore fluids that surround the apparatus 100 in use.

A substantially incompressible fluid, for example silicone oil 20, is provided in the chamber 21 defined (at least in part) by the interior of the bellows formation 11 and the inner surface 22 of the flexible member 14. The oil is incompressible, such that any expansion or contraction of the bellows formation 11 causes deflection of the flexible member 14 and vice versa. In operation, deflection of the bellows formation may be due to thermally and pressure induced volume changes of the lubricant or minor loss of lubricant through the seal.

The bellows formation 11 is preferably formed from a metal, for example Inconel or stainless steel. In preferred embodiments multiple annular metal rings 23 are welded together to form the bellows formation 11. The metal rings may be bevelled metal rings. The bellows formation is preferably a spring bellows formation so that a force is required to compress the bellows from an expanded configuration to a compressed or less expanded configuration. The formation is preferably elastically deformable along a central axis A-A.

A volume 24 is defined by the exterior 25 of the bellows formation 11, an inner surface of the housing 10, and one or more lubricant conduits 27 which extend from the housing to the bearings 5, and the seal 6. In use, the volume 24 is filled with a lubricant via a one way valve 28. With the housing filled with lubricant, the exterior of the bellows is immersed in the lubricant. The exterior of the bellows faces the lubricant or is exposed to the lubricant. The lubricant is preferably pressurised sufficiently to cause a compression of the bellows formation 11, and subsequent deflection of the flexible member 14, as shown in FIG. 5. A bleed port 29 may be provided to ensure that no air remains in the second volume 24.

In preferred embodiments the deflection of the flexible member 14 is limited to around 10% or less elongation, in order to ensure that the flexible member 14 does not wear out or fail due to fatigue after repeated uses. Preferably the lubrication system can be used on multiple runs in the wellbore with minimal maintenance between runs, in other words reusable. The bellows may be damaged if wellbore cuttings become lodged between the metal rings that form the spring bellows. By providing the flexible member to define a chamber with the interior of the bellows, and filling the chamber with a fluid, the bellows is separated from the wellbore fluid and wellbore cuttings and debris. Thus the lubrication system comprising the flexible member and chamber filled with fluid prevents wellbore cuttings and debris from interfering with the bellows formation.

In use, when the apparatus 100 conveys a sensor down a well bore, the ambient pressure of the wellbore fluid surrounding the apparatus 100 bears on the outer surface 19 of the flexible member 14. The flexible member 14 deflects under the pressure, transferring the pressure through the silicone oil 20 to the interior of the bellows formation 11. The bellows formation is free to expand axially to allow the transfer of pressure to the lubricant in the volume 24 defined by the housing 10. In use, the bellows formation is elastically compressed and consequently provides additional pressure to the lubricant in the second volume 24. In other words, the bellows provides a bias force against the lubricant in the housing. The bellows is biased to an expanded configuration. For example, the bellows is constructed in an expanded configuration, for example as in FIG. 4A, and a force is required to deflect the bellows formation from the expanded configuration to a compressed or less expanded configuration, for example as in FIG. 5. In this way the pressure of the lubricant within the bearings 5 and on the inside of the radial shaft seal 6 is kept at a slightly higher pressure (for example around 5 PSI higher) than the pressure of the fluid on the outside the seal 6, regardless of any change in wellbore pressure.

The system comprising a bellows is without parts moving in sliding contact and thus provides a lubrication system that is practically frictionless to respond immediately to changes in wellbore pressure to maintain a positive small pressure differential between the lubricant and the well bore environment. A small pressure differential (for example less that 20 psi) is optimal in order to minimise friction between the radial seal and wear sleeve.

Figure 7:
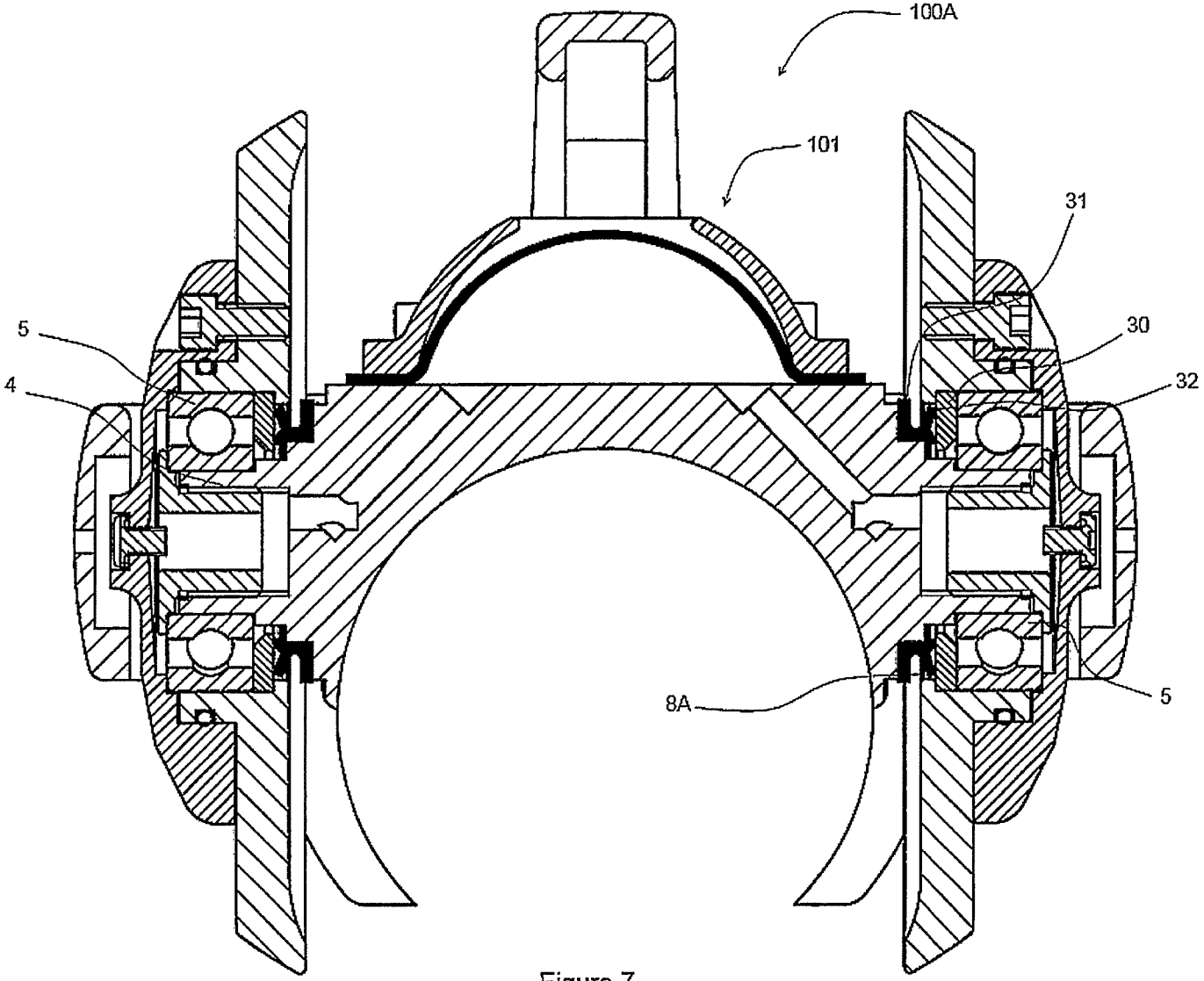
FIG. 7 Is a transverse cross-section view of another embodiment of the sensor transportation apparatus and alternative lubrication delivery means.

Referring next to FIG. 7, another embodiment of the sensor transportation apparatus is generally referenced by arrow 100A. In this embodiment the sleeve 9 is omitted and a disc component 30 is provided. The disc component 30 has a central aperture to allow it to be mounted to the axle 4 adjacent the bearing 5. An inner side of disc component 30 provides a wear surface 8A. The wear surface 8A (and optionally the entire disc 30) is preferably tungsten carbide and/or has a Vickers hardness of at least 1100, or at least 1300.

An axial seal 31 is mounted to the axle 4 and a lip 32 of the seal engages the wear surface 8A. The apparatus 100A is otherwise the same as apparatus 100 described above with reference to FIGS. 1-6.

By using ball bearings 5 in combination with a shaft seal 6, the static friction in the bearing assembly is kept to a minimum, and the apparatus 100 operates smoothly even when used in particularly shallow well bores and/or at a large depths.

In preferred embodiments the bearing 5 is a double row angular contact ball bearing. Double row ball bearings may be preferred due to their ability to roll freely when the load on the bearing includes an axial component, in particular an unbalanced axial component or torque such as that created when the wheels of the apparatus are in contact with the curved surface of the wellbore. Double row bearings also ensure that the wheel will rotate more concentrically with the axle with less wobble. This reduces runout at the seal, thereby increasing reliability and life of the rotary seal. In turn, ball bearing reliability and life is extended by the more reliable rotary seal. Further, rolling bearings provide a lowest static and dynamic drag and a minimal difference between static and dynamic drag.

In alternative preferred embodiments the bearing 5 are tapered roller bearings mounted to take axial loads in both directions. Taper Roller bearings may be preferred due to their ability to roll freely when the load on the bearing includes an axial component, in particular an unbalanced axial component or torque such as that created when the wheels of the apparatus are in contact with the curved surface of the wellbore.

In alternative preferred embodiments the bearing 5 are two angular contact bearings mounted to take axial loads in both directions. Angular contact ball bearings may be preferred due to their ability to roll freely when the load on the bearing includes an axial component, in particular an unbalanced axial component or torque such as that created when the wheels of the apparatus are in contact with the curved surface of the wellbore.

In alternative preferred embodiments the bearing 5 is a 4 point contact ball bearing. 4 point contact ball bearings may be preferred due to their ability to roll freely when the load on the bearing includes an axial component, in particular an unbalanced axial component or torque such as that created when the wheels of the apparatus are in contact with the curved surface of the wellbore.

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavor in any country in the world.

The invention may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the present invention.

What we claim is:

1. A sensor transportation apparatus for conveying a sensor assembly through a wellbore, the sensor transportation apparatus comprising:

at least one engagement structure to connect the sensor transportation apparatus to the sensor assembly, at least one axle, at least one wheel, a bearing connected to the axle between the wheel and the engagement structure, a shaft seal to prevent or reduce debris from the wellbore entering the bearing, and a lubrication delivery system to provide a lubricant to the bearing at a pressure which is greater than an ambient wellbore pressure, wherein the lubrication system comprises:

a spring bellows formation, and the apparatus comprising a housing to contain the lubricant, the housing in fluid communication with the bearing, the spring bellows formation sealingly mounted to the housing with at least a portion of the spring bellows formation received within the housing to provide a bias force so that the pressure in the lubricant is greater than the ambient wellbore pressure of a wellbore fluid surrounding the device;

a flexible member, an outer surface of the flexible member in communication with wellbore fluids surrounding the apparatus in use; and a liquid contained in a sealed chamber defined, at least in part, by the interior of the spring bellows formation and an inner surface of the flexible member.

2. The apparatus as claimed in claim 1, an exterior of the spring bellows formation is exposed to or facing the lubricant in use.

3. The apparatus as claimed in claim 1, wherein the flexible member is a resilient diaphragm.

4. The apparatus as claimed in claim 1, wherein the chamber has an invariable volume, such that deflection of the spring bellows formation causes deflection of the flexible member and vice-versa.

5. The apparatus as claimed in claim 1, wherein the liquid comprises silicone oil.

6. The apparatus as claimed in claim 1, wherein the lubricant is provided in a volume defined in part by the housing and an exterior of the spring bellows formation and the shaft seal.

7. The apparatus as claimed in claim 6, wherein the bearing is contained in said volume, immersed in the lubricant.

8. The apparatus as claimed in claim 6, wherein prior to use, the lubricant is forced into the volume, compressing the spring bellows formation.

9. The apparatus as claimed in claim 1, wherein the spring bellows formation maintains a higher pressure in the lubricant than the liquid filling the interior of the spring bellows formation and hence the wellbore fluid.

10. The apparatus as claimed in claim 1, wherein the spring bellows formation comprises a plurality of metal rings.

11. The apparatus as claimed in claim 10, wherein the metal rings are stainless steel alloy rings.

12. The apparatus as claimed in claim 1, wherein the bearing is between the wheel and the axle.

* * * * *